US007398029B2

(12) United States Patent
Jacobsen et al.

(10) Patent No.: US 7,398,029 B2
(45) Date of Patent: Jul. 8, 2008

(54) ADJUSTMENT OF PRINT JOB TO REDUCE COLOR TONER USAGE

(75) Inventors: Dana A. Jacobsen, Boise, ID (US); Terry M. Fritz, Boise, ID (US); Michael L Talley, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 289 days.

(21) Appl. No.: 11/174,224

(22) Filed: Jul. 2, 2005

(65) Prior Publication Data

US 2007/0003306 A1 Jan. 4, 2007

(51) Int. Cl.
*G03G 21/02* (2006.01)

(52) U.S. Cl. ..... 399/79; 399/80

(58) Field of Classification Search ..... 399/79, 399/80

See application file for complete search history.

(56) References Cited

U.S. PATENT DOCUMENTS

| | | | | |
|---|---|---|---|---|
| 5,252,995 | A | 10/1993 | Trask et al. | |
| 5,646,670 | A | 7/1997 | Seto et al. | |
| 5,663,750 | A * | 9/1997 | Sakuma | 347/7 |
| 5,751,434 | A * | 5/1998 | Narendranath et al. | 358/1.9 |
| 2006/0133832 | A1 * | 6/2006 | Watanabe et al. | 399/27 |

FOREIGN PATENT DOCUMENTS

GB 2382905 A * 6/2003

* cited by examiner

*Primary Examiner*—David M Gray
*Assistant Examiner*—Ryan D. Walsh

(57) ABSTRACT

It is determined whether a print job to be output on a color laser-printing device is to have reduced color toner usage. In response to determining that the print job is to have reduced color toner usage, the print job is adjusted so that the print job consumes less color toner when output on the color laser-printing device, by color-desaturating the print job.

33 Claims, 10 Drawing Sheets

ADJUSTMENT OF PRINT JOB TO REDUCE COLOR TONER USAGE

BACKGROUND

Traditionally laser-printing devices, such as laser printers, formed images on media in black-and-white and grayscale only. Color printing was thus accomplished using inkjet-printing devices, such as inkjet printers, or using other color printing devices. More recently, however, laser-printing devices have become available that form images on media in full color, and which are relatively inexpensively priced. As a result, many users are now migrating from black-and-white laser-printing devices to color laser-printing devices, so that one printing device can accommodate all their printing needs.

However, many users have discovered that color laser-printing devices can be expensive to maintain. In particular, whereas a black-and-white laser-printing device needs only a single, black toner cartridge, a color laser-printing device typically needs four toner cartridges: a black toner cartridge, as well as cyan, magenta, and yellow toner cartridges. (Alternatively, a color laser-printing device may use a toner cartridge employing all three colors, and optionally black.) These toner cartridges of different colors can be expensive to purchase. Therefore, some users have opted to minimize the use of color when forming images on media. However, current color laser-printing devices typically do not have the ability to easily minimize the usage of color toner when forming images on media.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
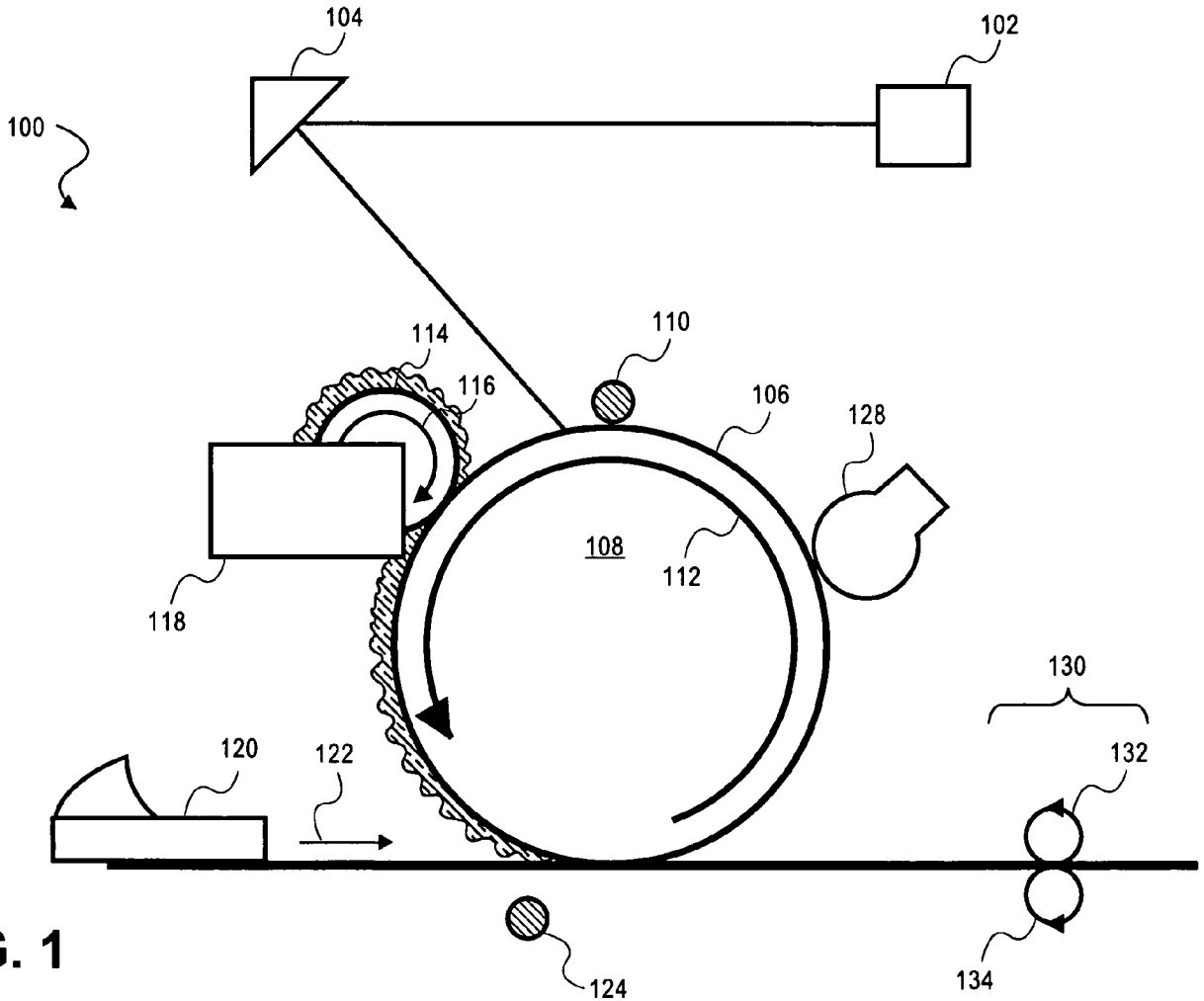
FIG. 1 is a diagram of the manner by which laser printing can be accomplished, according to an embodiment of the invention.

FIG. 1 shows an example laser-printing mechanism 100 by which laser printing can be accomplished, according to one embodiment of the invention. The laser-printing mechanism 100 may be a part of a laser printer or another type of laser-printing device. The photoconductor drum 108 is made from highly photoconductive material that is discharged by light photons. The photoconductor drum 108 may also be referred to as a photoreceptor drum, a photoconductor, an optical photoconductor, or an organic photoconductor. Initially, the drum 108 is given a total positive charge via a charge roller 110. The charge roller 110 is in contact with the drum 108 during image formation on the media 120 for precise alignment of the image to be formed on the media 120. At other times, during non-use, the charge roller 110 may be separated from the photoconductor drum 108, as will be described.

As the drum 108 revolves, the printing mechanism 100 shines a laser beam emanating from the laser beam light source 102, and reflected by the reflector 104, onto the surface 106 of the drum 108 to discharge certain points in accordance with an image. In this way, the laser draws, or scans, the image to be printed as a pattern of electrical charges, which can be referred to as an electrostatic image. The drum 108 rotates counter-clockwise, as indicated by the arrow 112. After the pattern has been set, the printing mechanism 100 coats the drum 108 with charged toner, which is a fine powder. The toner also has a positive charge, so the toner clings to the discharged areas of the drum 108, but not to the positively charged background.

The toner is dispensed by a developer roller 114 that rotates clockwise, as indicated by the arrow 116, against the drum 108, after having rotated through the toner hopper 118 to pick up toner. The developer roller 114 is also in contact with the drum 108 during image formation on the media 120 for precise alignment of the image to be formed on the media 120. At other times, during non-use, the developer roller 114 may be separated from the photoconductor drum 108, as will be described. With the powder pattern affixed, the drum 108 rolls over a sheet of media 120, which moves in the direction indicated by the arrow 122. Before the media 120 rolls under the drum 108, it is given a negative charge by the transfer roller 124. This charge is stronger than the charge of the electrostatic image, so the media 120 pulls the powder away from the drum 108. Since it is moving at the same speed as the drum 108, the media 120 picks up the image pattern exactly.

The printing mechanism 100 finally passes the media 120 through the fuser 130, which can be a pair of heated rollers 132 and 134 that move in opposite direction. As the media 120 passes through these rollers 132 and 134, the loose toner powder melts, fusing with the fibers in the media 120. The fuser 130 rolls the media 120 to an output tray, providing a printed page. After depositing the toner on the media 120, the drum 108 passes the discharge lamp 128, which is a bright light. This exposes the entire photoreceptor surface of the drum 108, erasing its electrical image, so that the process is ready to be repeated.

At least some components of the laser-printing mechanism 100 of FIG. 1 may be encased within a removable toner cartridge that can be replaced when the toner supply of the cartridge has been depleted. For instance, the toner hopper 118 or a corresponding component thereto, the photoconductor drum 108, the developer roller 114, and the charge roller 110 may all be encased within a removable toner cartridge. As such, when the toner supply present in the toner hopper 118 or the corresponding component thereto has been depleted, the toner cartridge is replaced with a new, fresh toner cartridge to continue forming images on media.

Furthermore, for illustrative simplicity the laser-printing mechanism 100 of FIG. 1 is depicted as a single color mechanism, in that the toner stored within the toner hopper 118 is a single color. For multiple-color printers, there can be more than one laser-printing mechanism within a given printer, which may share some components. As one example, there may be a black laser-printing mechanism, a cyan laser-printing mechanism, a magenta laser-printing mechanism, and a yellow laser-printing mechanism to achieve full-color printing.

Figure 2A:
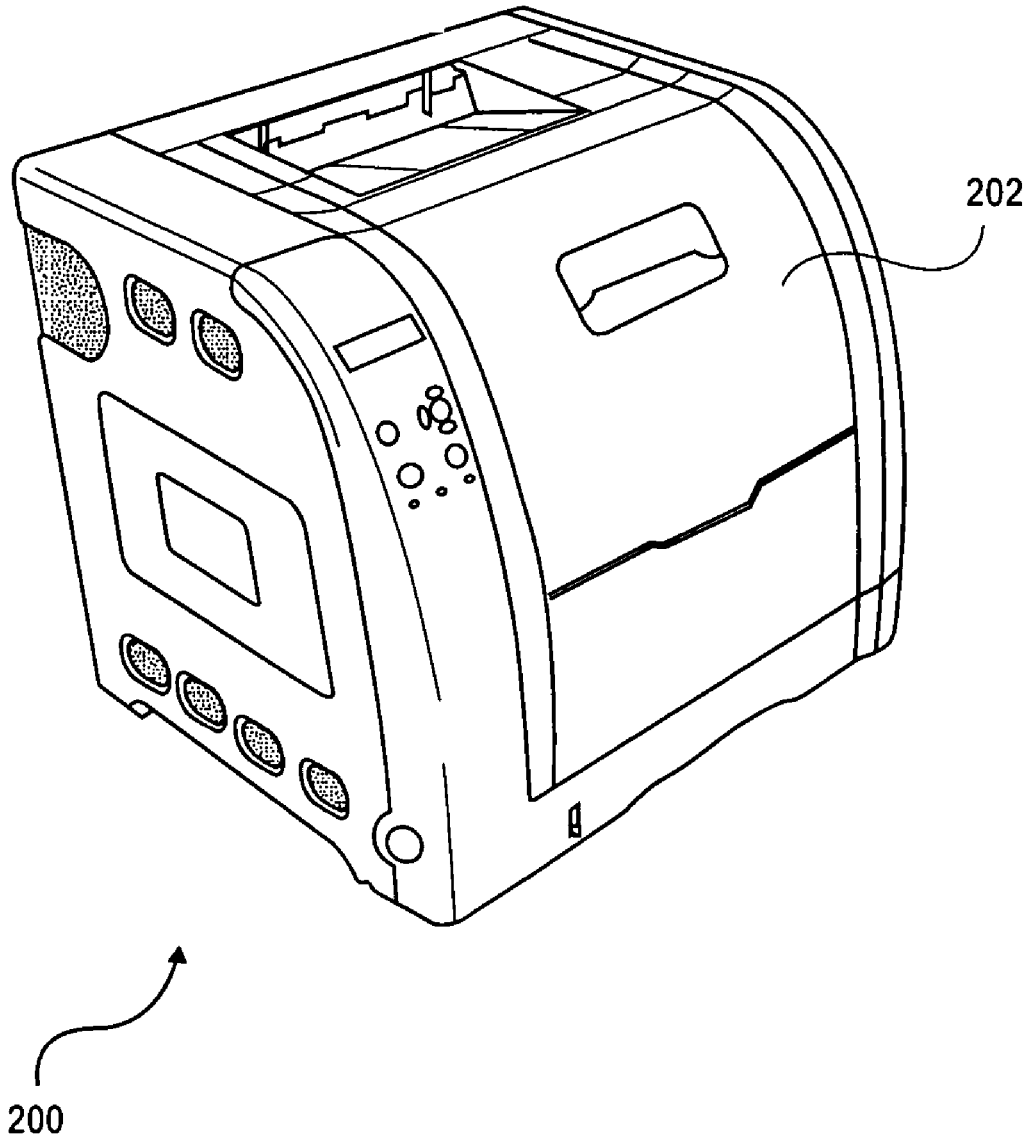
FIGS. 2A and 2B are diagrams of a laser printer having toner cartridges of differently colored toner to achieve full-color laser printing, according to an embodiment of the invention.
Figure 2B:
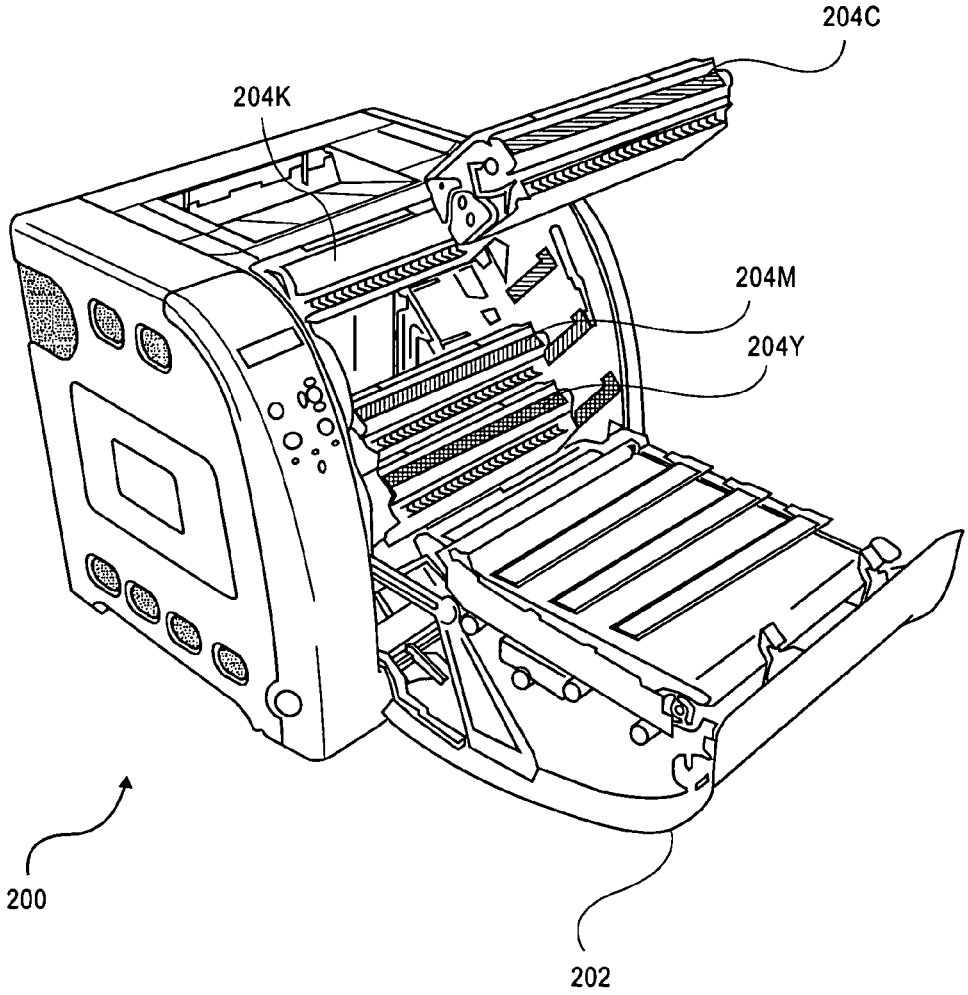

FIGS. 2A and 2B show an example of a multiple-color laser printer 200 that can be used to achieve full-color printing, according to an embodiment of the invention. The laser printer 200 is more generally a laser-printing device. In FIG. 2A, the cover 202 of the laser printer 200 is closed, whereas in FIG. 2B the cover 202 of the laser printer 200 is opened. As such, FIG. 2B shows that four different toner cartridges 204K, 204C, 204M, and 204Y can be inserted into the laser printer 200 to achieve full-color printing. The toner cartridge 204C is removed from the printer 200 in FIG. 2B, whereas the other cartridges 204K, 204M, and 204Y have been inserted into the printer 200 in FIG. 2B. The toner cartridges 204K, 204C, 204M, and 204Y correspond to black, cyan, magenta, and yellow toner, where combinations of these four colors can be used to achieve full-color printing. Alternatively, a toner cartridge may be employed that includes all three colors, and optionally black.

Figure 3:
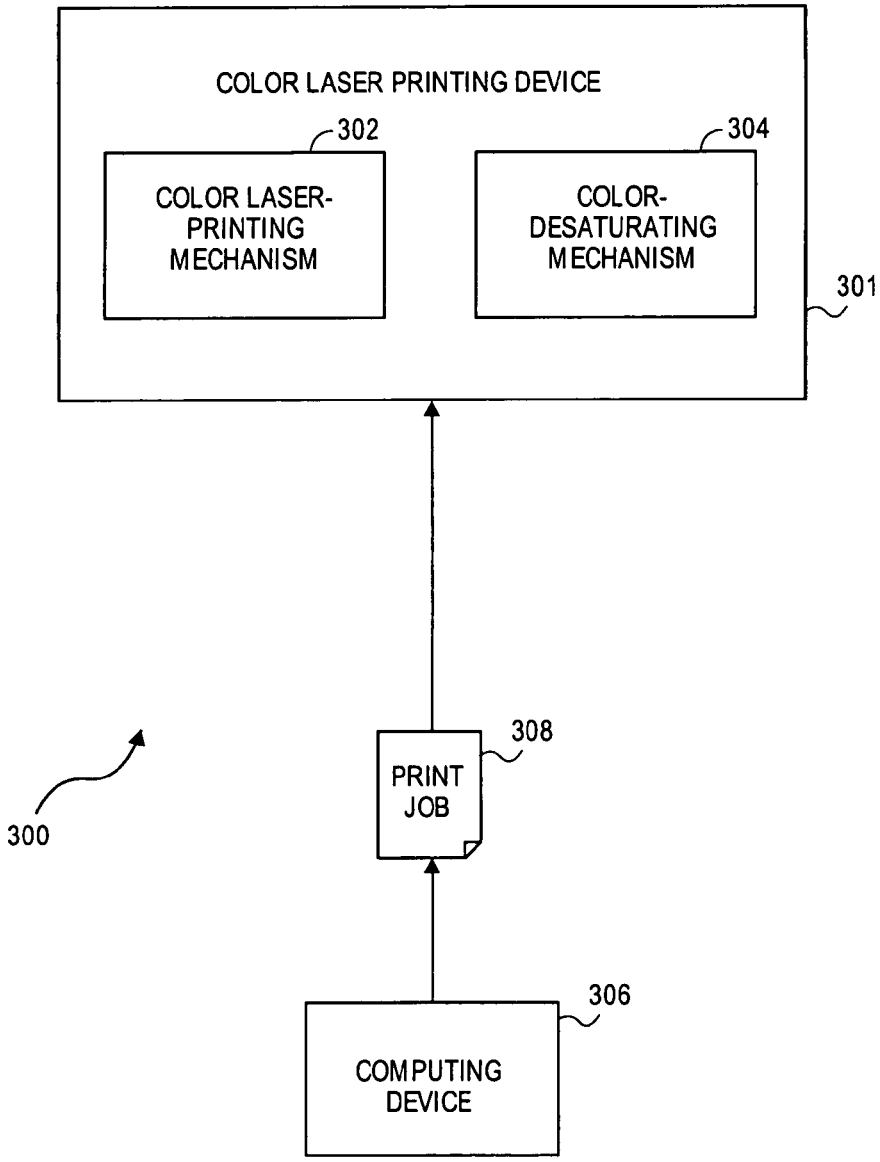
FIG. 3 is a block diagram of a system including a color laser-printing device, according to an embodiment of the invention.

FIG. 3 shows a system 300 including a color laser-printing device, according to an embodiment of the invention. The system 300 includes the color laser-printing device 301, as well as a computing device 306 that is communicatively connected to the color laser-printing device 301 in a wired or a wireless manner. The color laser laser-printing device 301 may be a color laser printer, such as the multiple-color laser printer 200 of FIGS. 2A and 2B. The computing device 306 may be a desktop or a laptop computer, or another type of computing device, such as a digital camera, a personal digital assistant (PDA) device, a mobile phone, a handheld computing device, and so on. While only one computing device 306 is depicted in FIG. 3, there can be more than one computing device communicatively connected to the color laser-printing device 301, such as over a wired and/or a wireless network.

The color laser-printing device 301 includes a color laser-printing mechanism 302, and a color-desaturating mechanism 304. The mechanism 302 is implemented in hardware, or a combination of hardware and software, whereas the mechanism 304 is implemented in hardware, software, or a combination of hardware and software. As can be appreciated by those of ordinary skill within the art, the device 301 can and typically does include other components and mechanisms, in addition to those depicted in FIG. 3. The color laser-printing mechanism 302 outputs a print job 308 received from the computing device 306 in color, such as by correspondingly forming images on media like paper. The color laser-printing mechanism 302 may include the mechanism 100 of FIG. 1 that has been described, for each color that it is capable of outputting. In particular, the color laser-printing mechanism 302 is capable of forming full-color images on media by combining black, cyan, magenta, and yellow toner to achieve full-color printing.

The color-desaturating mechanism 304 determines whether the print job 308 is to have reduced color toner usage, and in response to determining that the print job 308 is to have reduced color toner usage, adjusts the print job 308 so that it consumes less color toner when output by the color laser-printing mechanism 301. More specifically, the color-desaturating mechanism 304 adjusts the print job 308 so that it consumes less color toner when output by color-desaturating the print job. Various manners by which the color-desaturating mechanism 304 determines whether the print job 308 is to have reduced color toner usage, and by which the mechanism 304 color-desaturates the print job 308 to achieve reduced color toner usage, are described subsequently in the detailed description, in relation to different methods.

However, in general, color-desaturating the print job 308, as this terminology is used herein, means the following. First, the terminology color-desaturating the print job 308 is intended as short hand for desaturating the color of the print job 308, and/or reducing the color saturation of the print job 308. Second, color-desaturating the print job 308 reduces the cyan, magenta, and/or yellow toner that is used in outputting the print job 308 onto media, but does not necessarily reduce the black toner that is used in outputting the print job 308. Therefore, the terminology color toner as used herein encompasses any color of toner besides black, which is distinctively referred to as black toner. For instance, the terminology color toner can encompass cyan, magenta, and/or yellow toner. In other embodiments, other types of color—i.e., non-black—toner can be employed.

Third, color-desaturating the print job 308 lowers, decreases, or reduces the color saturation of the print job 308. Outputting the print job 308 via the color laser-printing mechanism 302 thus results in the color portions of the print job 308 being printed lighter than if the print job 308 did not have its color portions desaturated. However, the black-and-white portions of the print job 308 are not affected, and furthermore the consumption of black toner as may be used or needed to achieve color printing may not be reduced. For example, a given dot or pixel of the print job 308 may be a color dot or pixel, which is achieved by combining different amounts of black, cyan, magenta, and/or yellow toner. Color-desaturating the print job 308 does not in one embodiment include reducing the amount of black toner in printing such a color dot or pixel, but rather just includes reducing the amount of cyan, magenta, and/or yellow toner in printing this color dot or pixel.

It is also noted that in at least some embodiments of the invention, desaturating the color portions of the print job 308, or color-desaturating the print job 308, is different than simply reducing the density of color portions of the print job 308. Color-desaturation of the print job 308 can still result in the same density of the color portions of the print job 308, such as 1200×1200 dots-per-inch (dpi), 600×600 dpi, and so on. Rather, the amount or level of toner to print each dot, or pixel, of the color portions of the print job 308 is reduced. Specifically, the amount or level of cyan, magenta, and/or yellow toner to output each dot or pixel of the color portions of the print job 308 is reduced. It is noted that the amount or level of black toner to output each dot or pixel of the color and black-and-white portions of the print job 308 may not be reduced. Color-desaturation can preserve relative colors better than simply reducing the density of the color portions of the print job 308.

Figure 4:
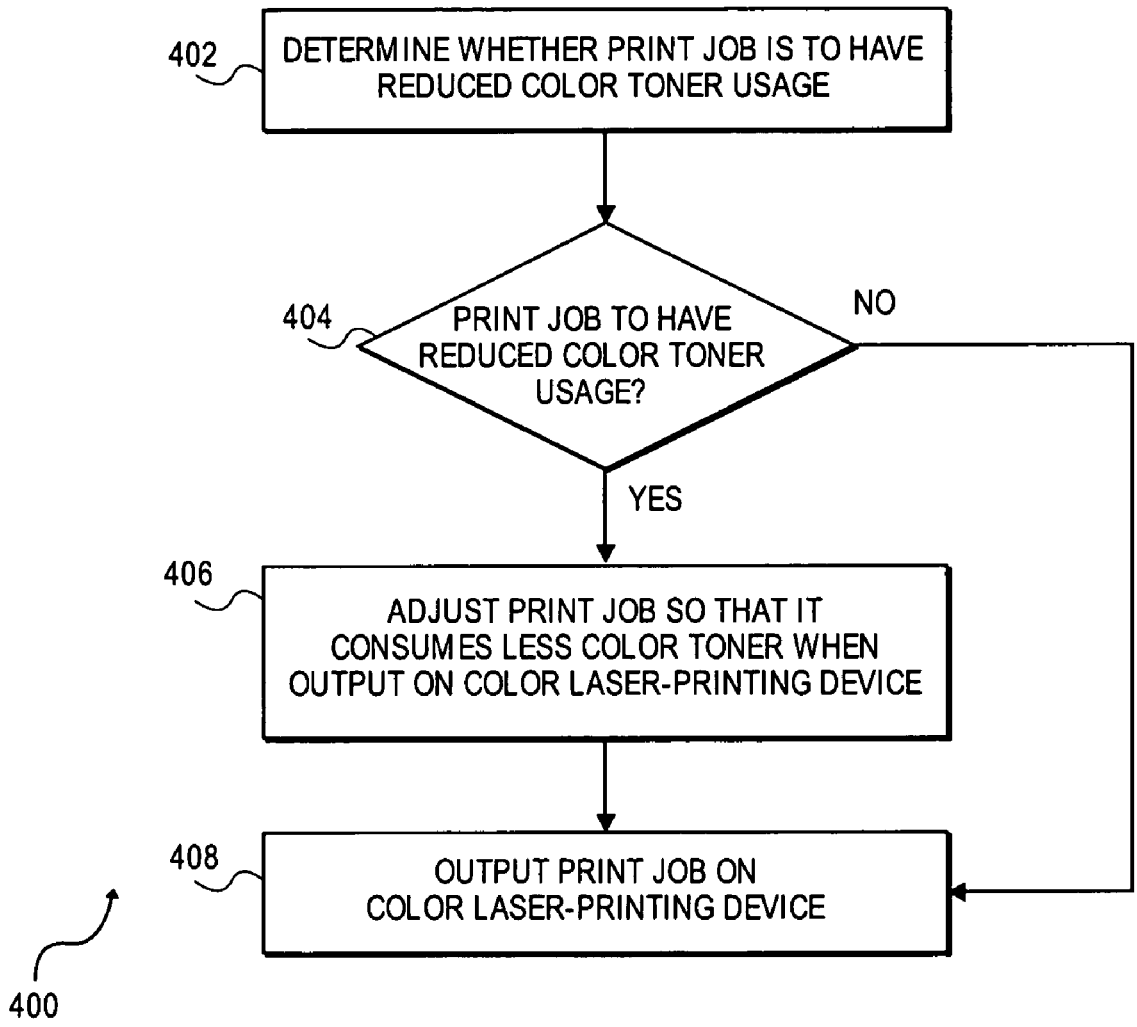
FIG. 4 is a flowchart of a method for outputting a print job on a color laser-printing device, according to an embodiment of the invention.

FIG. 4 shows a method 400 for achieving the color laser printing of a print job on a color laser-printing device, according to an embodiment of the invention. The method 400 may be performed in whole or in part by the color laser-printing device 301 of FIG. 3, such as by the color laser-printing mechanism 302 and/or the color-desaturating mechanism 304 of the device 310. Furthermore, the method 400 may be performed in part by the computing device 306 that generates the print job 308, or by another computing device that may receive the print job 308 and communicate the print job 308 to the color laser-printing device 301.

The method 400 may be implemented as one or more computer program parts stored on a computer-readable medium of an article of manufacture. The computer program parts may be different sections of computer programs, different object-oriented programming (OOP) software objects, different program subroutines or routines, and so on. The computer-readable medium may be a volatile or a non-volatile medium, as well as a magnetic medium, such as a hard disk drive, an optical medium, such as an optical disc, and/or a semiconductor medium, such as a memory, as well as other types of computer-readable media.

The method 400 is first described in general, and then specific embodiments for achieving various parts of the method 400 are described in more detail. The method 400 determines whether a print job is to have reduced color toner usage when being output on a color laser-printing device (402). If it is determined that the print job is to have reduced color toner usage (404), then the print job is adjusted so that the print job consumes less color toner when output on the color laser-printing device (406), by color-desaturating the print job. The print job, as has been adjusted, is then output on the color laser-printing device (408). If it is determined that the print job does not have to have reduced color toner usage (404), then the print job is output on the color laser-printing device (408) without being adjusted to reduce the color toner usage of the print job.

The part 408 of the method 400 is performed by a color laser-printing device, such as by the color laser-printing mechanism 302 of the color laser-printing device 301 of FIG. 3. The parts 402, 404, and 406 may in one embodiment be completely performed by a color-laser printing device, such as by the color-desaturating mechanism 304 of the color laser-printing device 301. In another embodiment, the parts 402, 404, and 406 may be completely performed by a computing device, such as the computing device 306 of FIG. 3 that generates the print job 308, or by a computing device that receives the print job 308 from the computing device 306 and communicates it to the color laser-printing device 301. In yet another embodiment, some of the parts 402, 404, and 406 of the method 400 may be performed by a color laser-printing device, and other of the parts 402, 404, and 406 may be performed by a computing device.

Different manners by which determining whether the print job is to have reduced color toner usage in the part 402 of the method 400 of FIG. 4 are now described. First, the type of the print job to be output on the color laser-printing device may be used as the basis upon which it is decided whether the print job is to have reduced color toner usage. For example, different types of print jobs include spreadsheet print jobs, presentation print jobs, letter print jobs, other word processing print jobs, and so on. If the print job in question is of a particular type, then it may be determined that the print job is to have reduced color toner usage. For instance, presentation print jobs may not be determined as having to have reduced color toner usage, whereas other types of print jobs may be determined as having to have reduced color toner usage.

Furthermore, the color coverage of the print job on an average page thereof may be used as the basis upon which it is decided whether the print job is to have reduced color toner usage. Color coverage is typically expressed as a percentage of an average page of media on which color toner is to be output. In one embodiment, if the color coverage of a print job is more than a predetermined threshold, then the print job is determined as having to have reduced color toner usage. In another embodiment, if the color coverage of a print job is less than a predetermined threshold, then the print job is determined as having to have reduced color toner usage. In this latter embodiment, then, important documents that typically will have large amounts of color toner usage, such as presentations, do not have their color toner usage decreased, whereas other documents that employ smaller amounts of color toner, such as word processing documents, do have their color toner usage decreased.

Furthermore, the print job may be adjusted as a whole based on its color coverage of an average page thereof, regardless of the specific color coverage of any given page, or it may be adjusted on a per-page basis, where a given page of the print job is adjusted depending on its specific color coverage. In one embodiment, the threshold that is used to determine whether a print job is to have reduced color toner usage, based on its color coverage as compared to this threshold, is dependent upon the user generating the print job. For example, executives may have to have a relatively high color coverage threshold for their print jobs to have reduced color toner usage, whereas other users may have a lower color coverage threshold for their print jobs to have reduced color toner usage.

Similarly, in another embodiment, the type of user generating a print job is the basis upon which it is determined whether the print job is to have its color toner usage reduced. For example, executives may never have their print jobs adjusted to reduce color toner usage. Other users, such as engineers, may by comparison always have their print jobs adjusted to reduce color toner usage. There may be more than two types of users into which given users are assigned to determine whether a given user's print jobs are to have their color toner usage reduced.

In one embodiment, a user is allowed to utilize a certain amount of color toner for each time period, such as each day. The user may decide him or herself whether to adjust the color toner usage of a given print job so that other print jobs do not have their usage of color toner reduced. Alternatively, the user may have a computing device or a color laser-printing device determine on a per-job basis whether color toner usage should be reduced. For example, based on past printing, such a device may determine that the user typically does not need to have his or her print jobs have their color toner reduced, such that print jobs originating from this user do not have reduced color toner usage until a limited amount of color toner remains for the user to use until the end of the time period in question.

It is noted that there can be a distinction between a particular individual, or user, and a particular class of individuals and users. For instance, reduced color toner usage may be on the basis of the specific identity of a user, or on the basis of the class of that user. As one example, three individuals Alice, Bob, and Frank may all be engineers. Alice thus may have her color toner usage reduced on the basis that she is a particular user—Alice—such that her color toner usage reduction thresholds, and so on, are particular to her, and not necessarily the same as those for Bob and Frank. Alternatively, Alice may have her color toner usage reduced on the basis that is an engineer, such that her color toner usage reduction thresholds, and so on, are the same as those for Bob and Frank, since Alice, Bob, and Frank are all engineers.

Furthermore, it is noted that the color toner usage reduction process may be performed in conjunction with a different, already performed process. For instance, the color toner usage reduction process of an embodiment of the invention may be integrated with toner limiting, gamut mapping, and color space conversion processes, among other types of processes.

Figure 5:
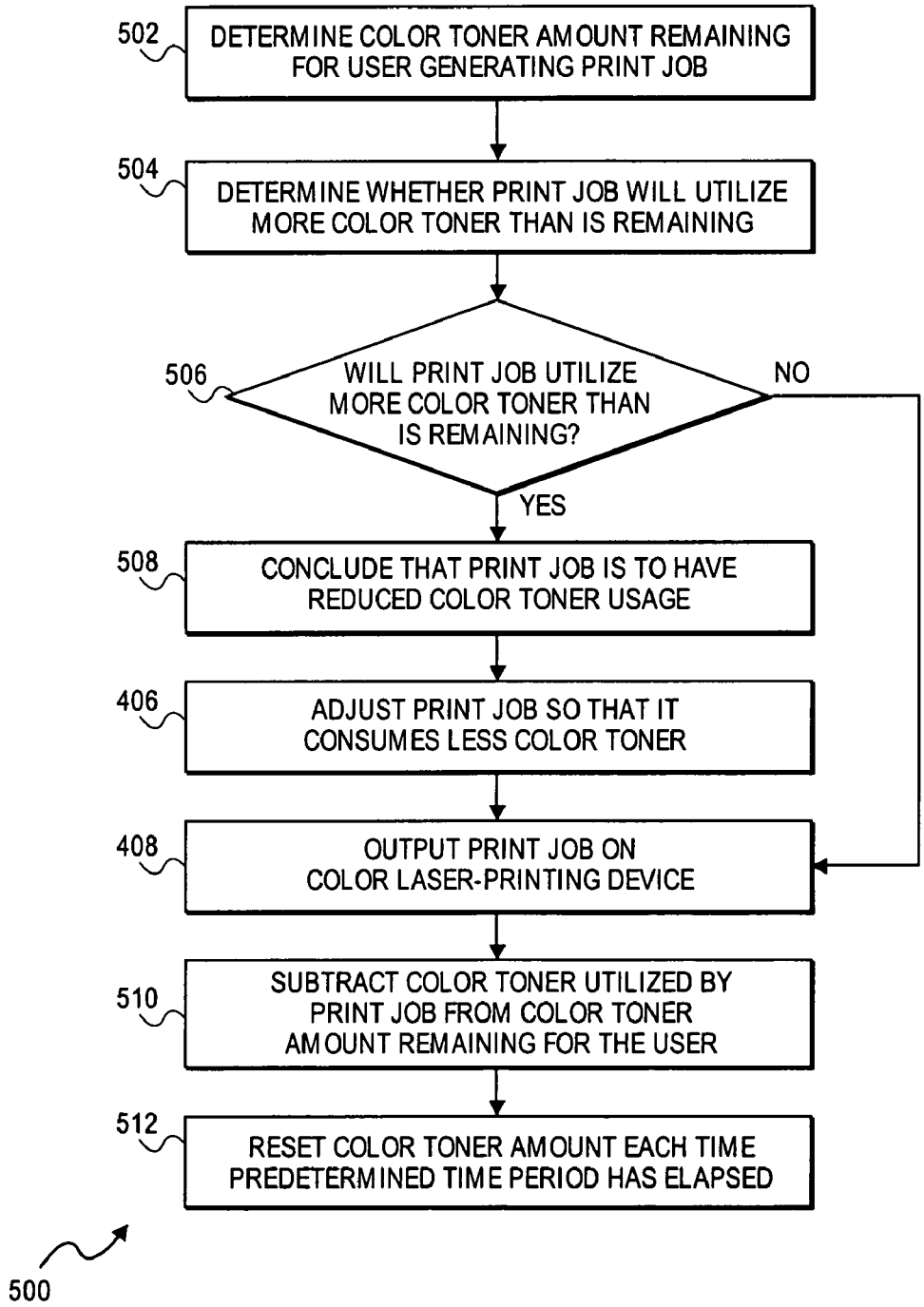
FIG. 5 is a flowchart of a method for reducing color toner usage of a print job based on an amount of color toner a user is allowed to consume in each predetermined time period, according to an embodiment of the invention.

FIG. 5 shows a method 500 for determining whether a print job is to have reduced color toner usage, based on the user generating the print job allows to use a certain amount of color toner per day or within another time period, according to an embodiment of the invention. Some parts of the method 500 are identically numbered in relation to the method 400 of FIG. 4, and are performed in the same way as has been described in relation to the method 400. That a user is allowed to use a certain amount of color toner may in one embodiment mean that a user is allowed to a use a certain amount of cyan, yellow, and magenta toner combined. That is, the user may be allowed to use a certain amount of color toner CT; when the total amount of cyan toner C, yellow toner Y, and magenta toner M exceed CT—such that C+Y+M>CT—the user is not allowed to use any more of any color toner during the time period in question.

In another embodiment, that a user is allowed to use a certain amount of color toner may in one embodiment mean that a user is allowed to use a certain amount of cyan, a certain amount of yellow, and a certain amount of magenta toner, individually. That is, the user may be allowed to use a certain amount of cyan toner Cm, a certain amount of yellow toner Ym, and a certain amount of magenta toner Mm. When the total amount of cyan toner C, yellow toner Y, or magenta toner M exceeds the correspondingly allowed amount—such that C>Cm, Y>Ym, or M>Mm—the user is not allowed to use any more of that color toner during the time period in question.

The method 500 first determines the color toner amount remaining for the user generating the print job, within the predetermined time period in question, such as a given day (502). The method 500 next determines whether the print job will utilize more color toner than the color toner amount remaining for this user (504). If the print job will utilize more color toner than the color toner amount remaining (506), then the method 500 concludes that the print job is to have reduced color toner usage (508). As a result, the print job is adjusted so that it will consume less color toner when output on a color laser-printing device (406). The print job is then output on the color laser-printing device (408), as adjusted. If the print job will not utilize more color toner than the amount remaining (506), however, then the print job is output on the color laser-printing device (408), without adjustment to reduce its color toner usage.

In either case, after the print job has been output on the color laser-printing device, the color toner utilized, or consumed, by the print job is subtracted from the color toner amount remaining for the user (510). Once the predetermined time period has elapsed, such as at the end of each day, the color toner amount is reset (512). The method 500 is performed each time a user generates a print job for output on the color laser-printing device.

Next, different manners by which a print job is adjusted so that it consumes less color toner when output on a color laser-printing device in the part 406 of the method 400 of FIG. 4 are now described. First, at some stage the print job is converted so that it has cyan, magenta, yellow, and black values corresponding to the resolution of the color laser-printing job. For example, a print job having a resolution X×Y pixels, where each pixel has a red value, a green value, and a blue value, is converted before output on the color laser-printing device to a resolution A×B pixels or dots, where each pixel or dot has a cyan value, a magenta value, a yellow value, and a black value. The cyan, magenta, yellow, and black values for a given dot or pixel correspond to the amount or level of that color toner which is to be deposited on the media to print the given dot or pixel.

In one embodiment, therefore, the cyan, magenta, and/or yellow values of the print job are reduced to adjust the print job so that it consumes less toner. This is also referred to as reducing the output gain of the cyan, magenta, and/or yellow channels of the print job. The reduction may be linear or non-linear, with the same reduction profile being used for all the color values of the print job, or different reduction profiles being used for each of the color values of the print job. A reduction profile is a description of how a color value of the print job is to be reduced, in a linear or a non-linear manner. For instance, a reduction profile may be a graph. As an example of a non-linear reduction, lower cyan, magenta, and yellow values may have little or no reduction, whereas higher cyan, magenta, and yellow values may have greater reduction.

Second, the print job may be used so that it consumes less color toner when output on a color laser-printing device by employing color tables that incorporate linear or non-linear reduction in the output gain of the cyan, magenta, and/or yellow channels of the print job, and thus to reduce color saturation of the print job. Thus, for each dot or pixel of the print job, a color table is consulted to determine the adjusted cyan, magenta, and/or yellow values of that dot or pixel. There may be different color tables depending on the amount of color toner usage reduction that is to be accomplished. Employing color tables has the advantage that the printing device or the computing device does not have to perform what can be complicated and time-consuming calculations for each print job, but rather just has to consult one or more color tables for each print job. Employing color tables is also advantageous in that they can be concurrently used to perform gamut adjustments, as well as other processes, so that the color tables can serve more than one purpose.

In another embodiment, the color saturation of the print job is dynamically reduced so that the color coverage of the print job is less than a threshold, on a per-print job or per-print job page basis. For example, a given print job may not be permitted to have more than five percent color coverage on any of its pages. For any page of the print job that exceeds five percent color coverage, adjustment is therefore performed so that the page does not exceed five percent color coverage.

Figure 6:
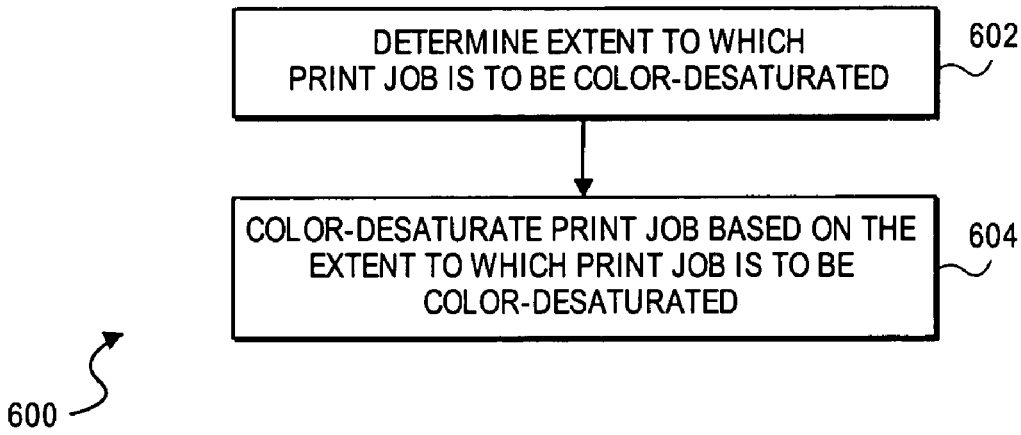
FIG. 6 is a flowchart of a method for reducing color toner usage of a print job based on the extent to which the print job is to be color-desaturated, according to an embodiment of the invention.

FIG. 6 thus shows a method 600 for reduced color toner usage of a print job by color-desaturating the print job based on the extent to which the print job is to be color-desaturated, according to an embodiment of the invention. The extent to which the print job is to be color-desaturated is first determined (602). For instance, as in the example of the previous paragraph, a given print job may not be permitted to have more than five percent color coverage on any of its pages, such that for any page that exceeds this threshold, adjustment is to be made. Therefore, the print job is color-desaturated based on the extent to which the print job is to be color-desaturated (604), to achieve a desired amount of color-desaturation, either on a per-print job or a per-print job page basis. It is noted that in one embodiment the method 600 is iteratively performed, so that after the print job is color-desaturated, it is determined whether the print job now satisfies whatever color toner usage restrictions are in place, and if the print job still does not satisfy these restrictions, the method 600 is again performed.

Figure 7:
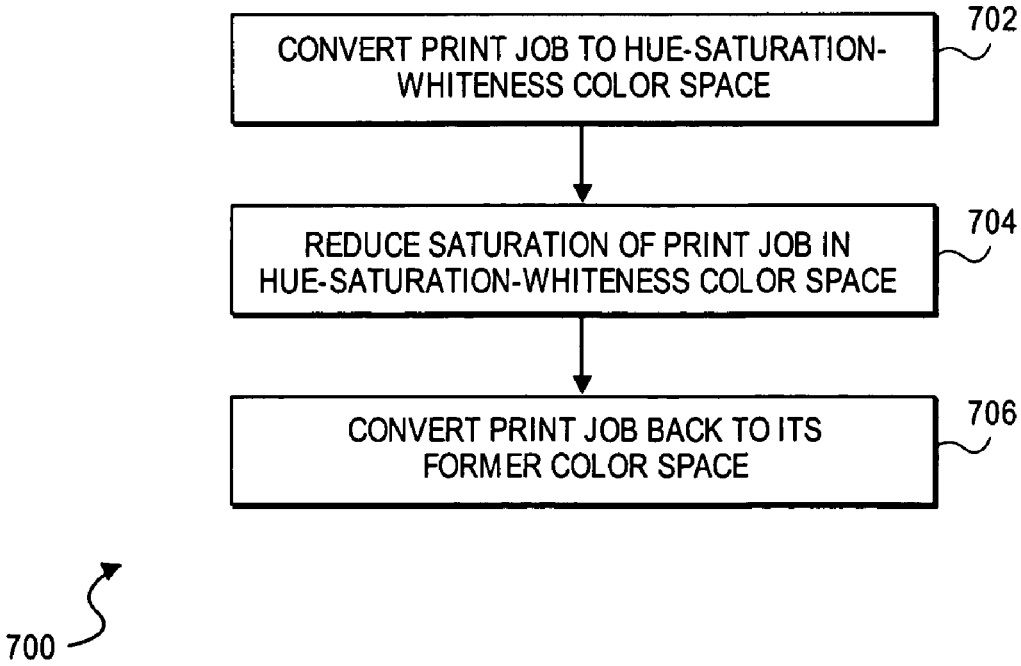
FIG. 7 is a flowchart of a method for reducing color toner usage of a print job by reducing saturation of the print job in the hue-saturation-whiteness (or brightness) color space, according to an embodiment of the invention.

FIG. 7 shows another method 700 for adjusting the color toner usage of a print job via color-desaturation, according to an embodiment of the invention. The method 700 specifically involves conversion of the print job in question to the hue-saturation-whiteness color space (702). A color space, or color model, is generally a system for describing color numerically. For instance, each pixel of a print job is typically described in a red-green-blue color space when displayed on a display device, and has a red value, green value, and a blue value, whereas each pixel of a print job is described in a cyan-magenta-yellow-black color space when printed on a printing device, and has a cyan value, a magenta value, a yellow value, and a black value.

The hue-saturation-whiteness color space is also known as the hue-saturation-brightness color space. This color space is similar to the way in which an artist may mix colors by adding black and white to pure pigments. The pigments correspond to the hues, and are measured in a circle from zero to 359 degrees. The saturation is the amount of black, and the whiteness or the brightness is the amount of white, where saturation and whiteness or brightness is expressed from zero to 100 percent.

Once the print job has been converted to the hue-saturation-whiteness color space, the saturation of the print job is specifically reduced (704). In particular, the saturation values of one or more pixels or dots of the print job are reduced. This reduction may be linear or non-linear, as has been described above in relation to cyan, magenta, and yellow channel output gain reduction. Once the print job has been color-desaturated in this way, it is converted back to its former color space (706), such as the RGB color space, the CMYK color space, and so on. It is noted that the method 700 is performed in one embodiment before conversion of the print job to the CMYK color space, because any specific user intention as to the black (K) channel in particular is not preserved when converting from the CMYK color space.

Figure 8:
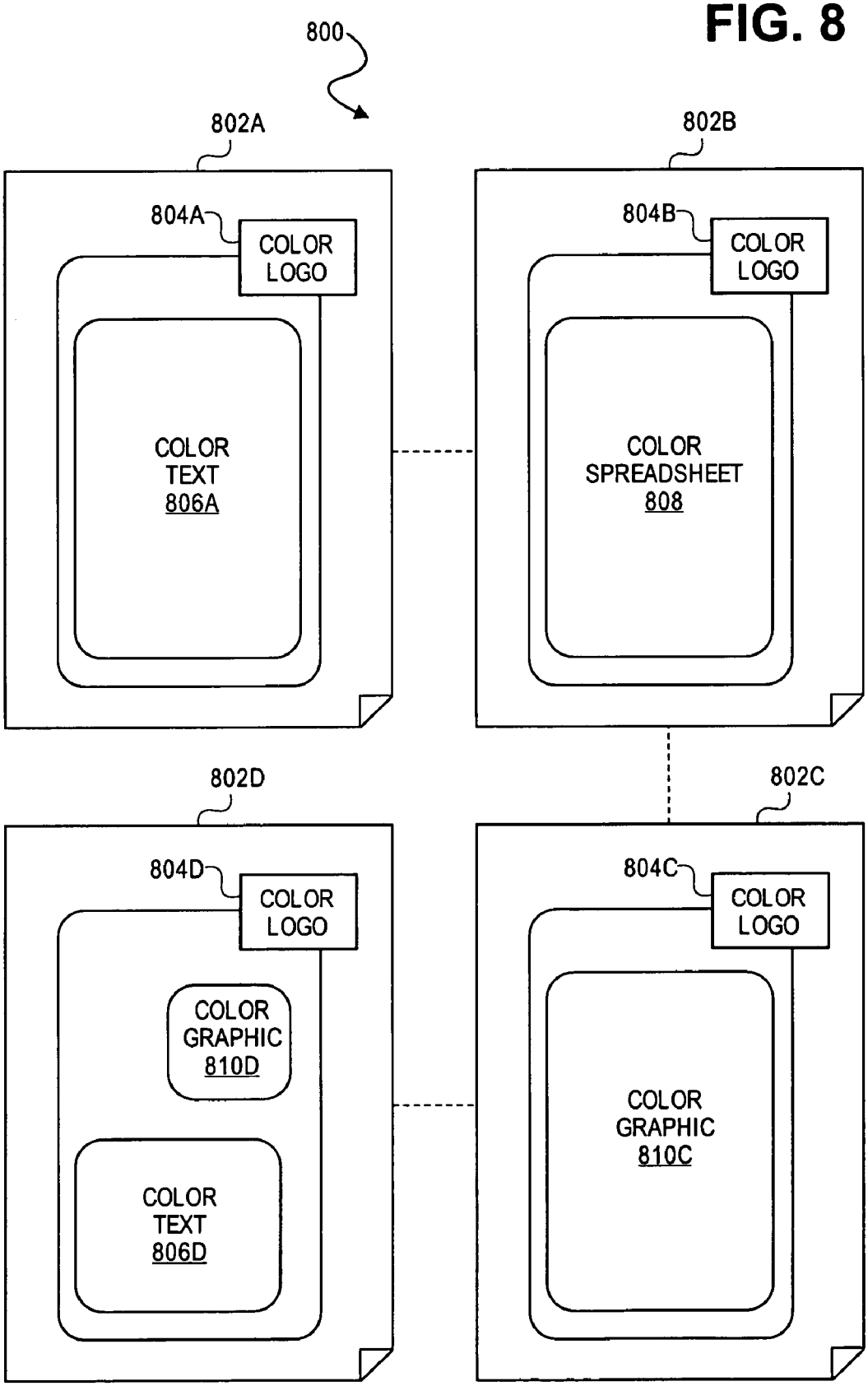
FIG. 8 is a diagram of an example print job having a number of pages with different types of objects, according to an embodiment of the invention.

The next manner by which color-desaturation of a print job can be accomplished to reduce color toner consumption of the print job is described in relation to FIG. 8. FIG. 8 shows an example print job 800, according to an embodiment of the invention. The print job 800 has four pages 802A, 802B, 802C, and 802D, collectively referred to as the pages 802. There are various different types of objects on the pages 802 of the print job 800. For instance, the pages 802 have color logo objects 804A, 804B, 804C, and 804D, collectively referred to as the logo objects 804. The pages 802A and 802D have color text objects 806A and 806D, collectively referred to as the color text objects 806. The page 802B has a color spreadsheet object 808. The pages 802C and 802D have color graphic objects 810C and 810D, collectively referred to as the color graphic objects 810. The print job 800 may thus be a presentation print job generated from a presentation source file within a presentation-oriented application computer program.

In one embodiment of the invention, color toner usage reduction is achieved by identifying the different types of objects 804, 806, 808, and 810, and color-desaturating these objects differently, which may include not color-desaturating some of the objects at all. Thus, higher-priority objects may have their color desaturated little or none, whereas lower-priority objects may have their color desaturated more. In this way, color toner usage reduction is achieved. An object is generally a distinct portion of a page of a print job, which may or may not correspond to distinct portions of other pages of the print job.

Figure 9:
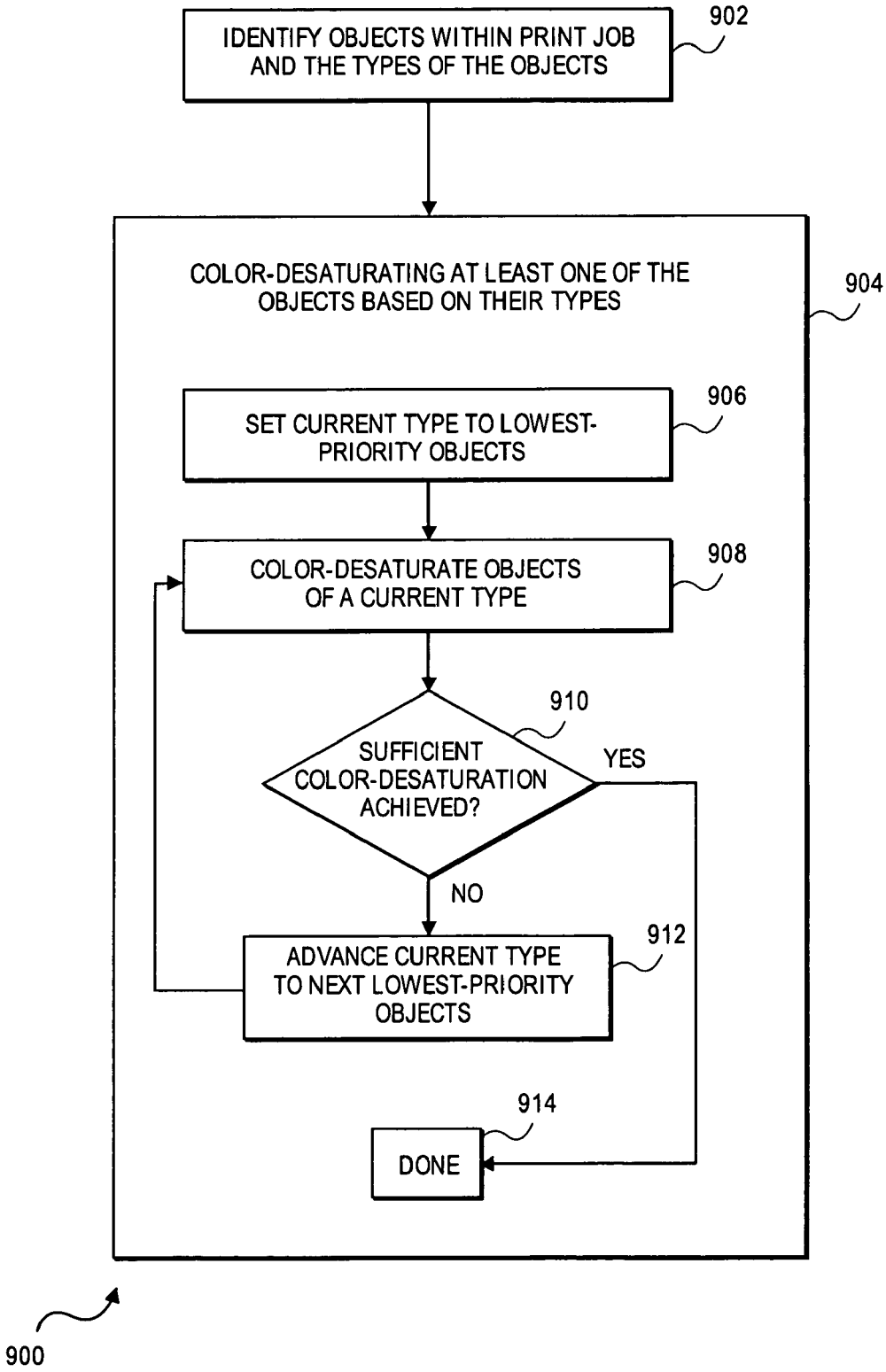
FIG. 9 is a flowchart of reducing color toner usage of a print job by color-desaturating different types of objects of a print job differently, according to an embodiment of the invention.

FIG. 9 shows a method 900 for color-desaturating a print job by color-desaturating different types of objects on the pages of the print job differently, according to an embodiment of the invention. The method 900 is specifically described in relation to the example print job 800 of FIG. 8 having the pages 802 with the objects 804, 806, 808, and 810. However, as can be appreciated by those of ordinary skill within the art, the method 900 can be performed in relation to any type of print job, having any number of pages, and any number and type of different objects.

The method 900 first identifies the different objects within the pages of the print job (902). For example, in the context of the example print job 800 of FIG. 8, the method 900 identifies the color logo objects 804, the color text objects 806, the color spreadsheet object 808, and the color graphic objects 810. Object and object type identification may be accomplished in a number of different ways. First, as the user is creating the source file from which the print job in question has been generated, within an application computer program on a computing device, the user may manually tag the objects within the source file with their types on which basis color-desaturation is to occur. Thus, the user identifies the objects 804 and denotes these objects as logo objects, identifies the objects 806 and denotes these objects as color text objects, and so on.

Second, a computing device or the color laser-printing device may scan the print job 800 of FIG. 8 after it has been generated to locate the objects 804, 806, 808, and 810, and determine or identify their types on which basis color-desaturation is to occur. For example, some types of page description languages (PDL's) in accordance with which the print job 800 may be defined may automatically tag objects and their types. As such, scanning the print job results in locating the objects and identifying their types. A PDL is generally a device-independent, high-level language for commanding a printer to print text and graphics on a page. Examples of PDL's include PostScript®, and the Printer Control Language (PCL).

Third, a computing device or the color laser-printing device may scan the print job 800 of FIG. 8 after it has been generated, to determine commonalities among the pages of the print job, and tag such commonalities as objects of the same type. This embodiment may be utilized where the print job has not been generated in accordance with a PDL that provides for object tagging and typing. For example, scanning the print job 800 may identify that the same color graphic is present in the upper right-hand corner of each of the pages 802. This color graphic may be considered a color logo object, and assigned a particular object type. In one embodiment, basic rules may be predefined and consulted during the scanning process to assist in identifying objects.

After the objects within the print job and their types have been identified, at least one of the objects is color-desaturated based on its type (904). For instance, relatively high-priority type objects may not be color-desaturated much, if at all, whereas relatively low-priority type objects may be color-desaturated to great degree. With respect to the example print job 800 of FIG. 8, the color logo objects 804 may be deemed as high-priority objects that are color-desaturated little if at all, whereas the color graphic objects 810 may be deemed as low-priority objects that are color-desaturated significantly to reduce color toner usage by the print job 800. Thus, different types of objects can be color-desaturated differently.

In one embodiment, desaturation of one or more of the objects is accomplished by performing parts 906, 908, 910, 912, and 914 of the method 900. First, a current object type is set to the lowest-priority type objects (906). The objects of this current type are color-desaturated (908). If such color-desaturation does not result in sufficient color-desaturation of the print job as a whole (910), then the current object type is advanced to the next lowest-priority type objects (912), and the process is repeated at the part 908. At some stage, color-desaturation of the objects of the current type results in sufficient color-desaturation of the print job having been achieved (910), in which case the process is finished (914).

In one embodiment, the method 900 is performed with more exacting granularity than has been described. That is, it is known how much color toner each of the objects will use a priori. Therefore, rather than just iteratively color-desaturating low-priority objects and not proceeding to higher-priority objects unless further color-desaturation is needed, the method 900 can alternatively perform lesser color-desaturation on higher-priority objects, and greater desaturation on lower-priority objects.

It is noted that the particular color-desaturation that is performed in the part 908 may be based on the current type of the objects that are to be color-desaturated. For instance, lower-priority type objects are color-desaturated less than higher-priority type objects are. In this way, objects of different types are iteratively color-desaturated until sufficient color-desaturation has occurred to reduce color toner usage by more than a threshold amount when the print job in question is output to the color laser-printing device.

Embodiments of the invention to reduce color toner usage of a print job when it is output to a color laser-printing device may also be combined in relation to ensuring that outputting a print job on the color laser-printing device, or other printing device, does not exceed a predetermined threshold cost. For example, a user may have a certain amount of monetary currency to spend or consume in outputting print jobs per day or other predetermined time period. So that the user does not exceed this dollar or other monetary current amount, adjustments to a print job may be made to lower the cost of printing the print job. Such adjustments can include color-desaturating the print job so that color toner usage is reduced, as has been described.

A user may thus be provided with the current value of an account, so that he or she may best gauge how to output print jobs to printing devices. The current value of the account may be reset after each predetermined time period is elapsed, such as at the beginning of every day. The user may also be provided with the estimated cost of a current print job, such that the user may have the ability to adjust the print job to lower its cost and have less impact on the user's current account value. Where the user's current account value is too small to output a current print job, a suggested adjustment to the print job may be offered to the user, or may automatically be performed, to reduce the cost of the current print job so that it can be printed in consideration of the user's current account value.

Figure 10:
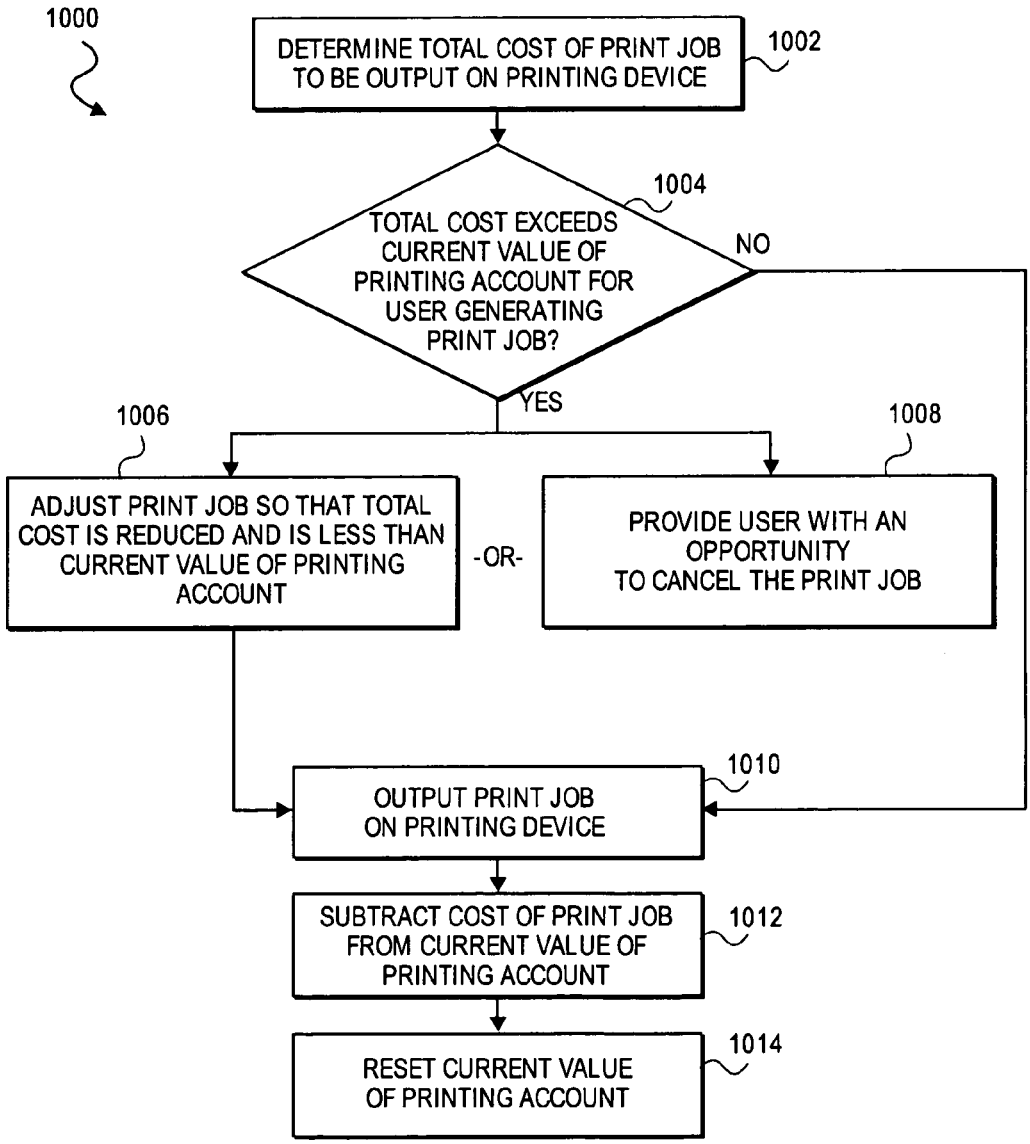
FIG. 10 is a flowchart of a method for limiting how much a user can spend during each time period, such as per day, in outputting print jobs to a printing device, according to an embodiment of the invention.

Therefore, FIG. 10 shows a method 1000 for limiting how much a user can spend during each time period, such as per day, to output print jobs to a printing device, according to an embodiment of the invention. The method 1000 can be integrated with the other methods that have been described herein, or the method 1000 can be performed on its own, independently and separately to the other methods that have been described. The method 1000 first determines the total cost of a print job to be output on a printing device (1002), such as a color laser-printing device.

Determining the total cost of the print job may include determining the cost of black toner and color toner in the case of output to a color laser-printing device, or black ink and color ink in the case of output to a color inkjet-printing device, that will be consumed by the print job. Determining the total cost of the print job may further include the cost of fuser usage during output of the print job to a laser-printing device. Determining the total cost of the print job can include the cost of media, as well as the cost of finishing options, such as stapling, folding, and so on, during output of the print job to a printing device. Determining the total cost of the print job may further include other costs, such as the cost of electricity, depreciation of the printing device resulting from the print job, and so on.

If the total cost of the print job exceeds the current value of the print account for the user generating the print job (1004), then the method 1000 performs one of two actions, steps, or acts. First, the print job may be adjusted so that the total cost of the print job is reduced, and is less than the current value of the printing account (1006). Second, the user may be provided with an opportunity to cancel the print job (1008), or adjust the print job him or herself so that its total cost is less than the current value of the printing account.

Adjusting the print job so that the total cost thereof is reduced and is less than the current value of the printing account can include color-desaturating the print job to reduce color toner usage, as has been described. Adjusting the print job to reduces its total cost may further include outputting the print job in black-and-white or grayscale, instead of in color, as well as outputting the print job on less expensive media. Adjusting the print job to reduce its total cost can also include printing more than one page of the print job on a side of a media sheet, instead of printing just one page on a side of a media sheet. Adjusting the print job to reduce its total cost may further include duplexing the print job, so that its pages are printed on both sides of each media sheet, as well as causing the printing device to output the print job using a predefined economy mode. Adjusting the print job may further include other steps, acts, and actions, such as outputting the print job to a different printing device that results in the cost of the print job being reduced, and so on.

After the print job has been adjusted to reduce its total cost, the print job is output on a printing device (1010), such as a color laser-printing device. Similarly, where the total cost of the print job does not exceed the current value of the user's printing account (1004), then the print job is output on the printing device (1010), albeit without adjustment. After printing, the cost of the print job is subtracted from the current value of the user's printing account (1012). The current value of the user's printing account is reset each time a predetermined period has elapsed (1014). For example, every day the user may be provided with a maximum value in his or her printing account. The method 1000 of FIG. 10 is performed each time a print job is to be output on a printing device.

It is noted that, although specific embodiments have been illustrated and described herein, it will be appreciated by those of ordinary skill in the art that any arrangement calculated to achieve the same purpose may be substituted for the specific embodiments shown. This application is thus intended to cover any adaptations or variations of embodiments of the present invention. Therefore, it is manifestly intended that this invention be limited only by the claims and equivalents thereof.

We claim:

1. A method comprising:

determining whether a print job to be output on a color laser-printing device is to have reduced color toner usage at least by comparing a color coverage of the print job to a threshold, the color coverage of the print job defined as a percentage of color toner on an average media sheet to result from printing the print job; and, in response to determining that the print job is to have reduced color toner usage, adjusting the print job so that the print job consumes less color toner when output on the color laser-printing device, by color-desaturating the print job, wherein determining whether the print job to be output on the color laser-printing device is to have reduced color toner usage comprises determining whether the color coverage of the print job is less than the threshold, such that the printer job is adjusted to have reduced color toner usage where the color coverage of the print job is less than the threshold.

2. The method of claim 1, further comprising outputting the print job on the color laser-printing device.

3. The method of claim 1, wherein determining whether the print job to be output on the color laser-printing device is to have reduced color toner usage further comprises determining whether the print job to be output on the color laser-printing device is to have reduced color toner usage based on a type of the print job.

4. The method of claim 1, wherein determining whether the print job to be output on the color laser-printing device is to have reduced color toner usage comprises determining whether the color coverage of the print job is greater than the threshold, such that the print job is adjusted to have reduced color toner usage where the color coverage of the print job is greater than the threshold.

5. The method of claim 1, wherein the threshold is based on a user generating the print job.

6. The method of claim 1, wherein determining whether the print job to be output on the color laser-printing device is to have reduced color toner usage further comprises determining whether the print job to be output on the color laser-printing device is to have reduced color toner usage based on a user generating the print job.

7. The method of claim 1, wherein determining whether the print job to be output on the color laser-printing device is to have reduced color toner usage further comprises determining whether the print job is to have reduced color toner usage based on an amount of color toner a user generating the print job is allowed to use within a given time period.

8. The method of claim 1, wherein determining whether the print job to be output on the color laser-printing device is to have reduced color toner usage further comprises:

determining a color toner amount remaining for a user generating the print job;

determining whether the print job will utilize more color toner than the color toner amount remaining for the user; and, in response to determining that the print job will utilize more color toner than the color toner amount remaining for the user, concluding that the print job is to have reduced color toner usage so that the color toner utilized by the print job does not exceed the color toner amount remaining for the user.

9. The method of claim 8, further comprising:

after outputting of the print job on the color laser-printing device, subtracting the color toner utilized by the print job from the color toner amount remaining; and, resetting the color toner amount each time a predetermined time period has elapsed.

10. The method of claim 1, wherein color-desaturating the print job comprises:

converting the print job to a hue-saturation-whiteness color space;

reducing saturation of the print job in the hue-saturation-whiteness color space; and, converting the print job back to a former color space of the print job.

11. The method of claim 1, where color-desaturating the print job comprises reducing output gain of each of at least one of cyan, magenta, and yellow channels of the print job.

12. The method of claim 1, wherein color-desaturating the print job comprises using one or more color tables to reduce saturation of the print job.

13. The method of claim 1, wherein color-desaturating the print job comprises reducing saturation of the print job so that color coverage of the print job is less than a threshold.

14. The method of claim 1, wherein color-desaturating the print job comprises:

determining an extent to which the print job is to be color-desaturated; and, color-desaturating the print job based on the extent to which the print job is to be color-desaturated.

15. The method of claim 1, wherein color-desaturating the print job comprises:

identifying a plurality of objects within the print job; and, color-desaturating each of at least one of the objects based on a type of the object.

16. The method of claim 15, wherein identifying the plurality of objects within the print job comprises a user manually tagging the objects within a source file from which the print job is generated, each object tagged with the type of the object on which basis color-desaturation is to occur.

17. The method of claim 15, wherein identifying the plurality of objects within the print job comprises scanning the print job after the print job has been generated to locate the objects and identify the type of each object on which basis color-desaturation is to occur.

18. The method of claim 15, wherein identifying the plurality of objects within the print job comprises determining that a particular object is present on each of a plurality of pages of the print job.

19. The method of claim 15, wherein color-desaturating each of at least one of the objects based on the type of the object comprises differently color-desaturating objects of different types.

20. The method of claim 15, wherein color-desaturating each of at least one of the objects based on the type of the object comprises:

color-desaturating objects of a first type; and, where sufficient color-desaturation has not occurred to reduce color toner usage by more than a threshold amount when the print job is output on the color laser-printing device, color-desaturating objects of a second type.

21. The method of claim 15, wherein color-desaturating each of at least one of the objects based on the type of the object comprises iteratively color-desaturating objects of different types until sufficient color-desaturation has occurred to reduce color toner usage by more than a threshold amount when the print job is output on the color laser-printing device.

22. The method of claim 1, further comprising:

determining a total cost of the print job to be output on the color laser-printing device; and, where the total cost of the print job exceeds a current value of a printing account for a user generating the print job, adjusting the print job so that the total cost of the print job is reduced and is less than the current value of the printing account.

23. The method of claim 22, wherein determining the total cost of the print job comprises at least one of determining a cost of black toner and color toner to be consumed during output of the print job;

determining a cost of fuser usage during output of the print job;

determining a cost of media used during output of the print job; and, determining a cost of finishing options during output of the print job.

24. The method of claim 22, wherein adjusting the print job comprises at least one of:

outputting the print job in black-and-white only to reduce the total cost of the print job;

color-desaturating the print job to reduce the total cost of the print job;

outputting the print job on less expensive media to reduce the total cost of the print job;

printing more than one page of the print job on a side of a media sheet to reduce the total cost of the print job;

duplexing the print job to reduce the total cost of the print job; and, causing the color laser-printing device to output the print job using an economy mode.

25. A color laser-printing device comprising:

a color laser-printing mechanism to output a print job; and, a mechanism to, in response to determining whether the print job to be output is to have reduced color toner usage, adjust the print job so that the print job consumes less color toner when output, by color-desaturating the print job, wherein one or more of the mechanism is to determine whether the print job to be output is to have reduced color toner usage at least by comparing a color coverage of the print job to a threshold, the color coverage of the print job defined as a percentage of color toner on an average media sheet to result from printing the print job; and, the mechanism is to determine whether the print job to be output is to have reduced color toner usage at least based on an amount of color toner a user generating the print job is allowed to use within a given time period, the given time period encompassing a plurality of print jobs of the user, and wherein the mechanism is to determine whether the print job to be output is to have reduced color toner usage by further determining whether the print job will utilize more color toner than a color toner amount remaining for the user, where the color toner amount is reset each time a predetermined time period has elapsed.

26. The color laser-printing device of claim 25, wherein the mechanism is to determine whether the print job to be output is to have reduced color toner usage further based on at least one of a type of the print job and the user generating the print job.

27. The color laser-printing device of claim 25, wherein the mechanism is to determine whether the print job to be output is to have reduced color toner usage by further determining whether the color coverage of the print job is one of greater than and less than a threshold.

28. The color laser-printing device of claim 25, wherein the mechanism is to color-desaturate the print job by at least one of one of:

reducing saturation of the print job in a hue-saturation-whiteness color space;

reducing output gain of each of at least one of cyan, magenta, and yellow channels of the print job;

by using one or more color tables; and, identifying objects within the print job, and color-desaturating each of at least one of the objects based on a type of the object.

29. A color laser-printing device comprising:

a color laser-printing mechanism to output a print job; and, means for determining that the print job to be output is to have reduced color toner usage, and for adjusting the print job so that the print job consumes less color toner when output, by color-desaturating the print job, wherein one or more of the means is to determine whether the print job to be output is to have reduced color toner usage at least by comparing a color coverage of the print job to a threshold, the color coverage of the print job defined as a percentage of color toner on an average media sheet to result from printing the print job; and, the means is to determined whether the print job to be output is to have reduced color toner usage at least based on an amount of color toner a user generating the print job is allowed to use within a given time period, the given time period encompassing a plurality of print jobs of the user, and wherein the means is to determine whether the print job to be output is to have reduced color toner usage by further:

determining a color toner amount remaining for a user generating the print job:

determining whether the print job will utilize more color toner than the color toner amount remaining for the user; and, in response to determining that the print job will utilize more color toner than the color toner amount remaining for the user, concluding that the print job is to have reduced color toner usage so that the color toner utilized by the print job does not exceed the color toner amount remaining for the user.

30. A method comprising:

determining whether a print job to be output on a color laser-printing device is to have reduced color toner usage at least based on an amount of color toner a user generating the print job is allowed to use within a given time period, the given time period encompassing a plurality of print jobs of the user; and, in response to determining that the print job is to have reduced color toner usage, adjusting the print job so that the print job consumes less color toner when output on the color laser-printing device, by color-desaturating the print job.

31. The method of claim 30, wherein determining whether the print job to be output on the color laser-printing device is to have reduced color toner usage further comprises:

determining a color toner amount remaining for a user generating the print job;

determining whether the print job will utilize more color toner than the color toner amount remaining for the user; and, in response to determining that the print job will utilize more color toner than the color toner amount remaining for the user, concluding that the print job is to have reduced color toner usage so that the color toner utilized by the print job does not exceed the color toner amount remaining for the user.

32. The method of claim 30, wherein the amount of color toner the user generating the print job is allowed to use within the given time period is a total amount of all different colors of toner combined, such that when usage of all the different colors of toner combined exceed a threshold during the given time period, the user is not allowed to use any more of any of the different colors of toner during the given time period.

33. The method of claim 30, wherein the given time period is a day.

* * * * *

UNITED STATES PATENT AND TRADEMARK OFFICE

CERTIFICATE OF CORRECTION

PATENT NO. : 7,398,029 B2
APPLICATION NO. : 11/174224
DATED : July 8, 2008
INVENTOR(S) : Dana A. Jacobsen et al.

It is certified that error appears in the above-identified patent and that said Letters Patent is hereby corrected as shown below:

In column 14, line 15, in Claim 11, delete “where” and insert -- wherein --, therefor.

In column 15, line 10, in Claim 23, delete “one of” and insert -- one of: --, therefor.

In column 15, line 41, in Claim 25, after “of” insert -- : --.

In column 16, line 5, in Claim 28, after “of” delete “one of”.

In column 16, line 20, in Claim 29, after “of” insert -- : --.

In column 16, line 27, in Claim 29, delete “determined” and insert -- determine --, therefor.

In column 16, line 38, in Claim 29, delete “job:” and insert -- job; --, therefor.

Signed and Sealed this

Fourth Day of November, 2008

JON W. DUDAS
*Director of the United States Patent and Trademark Office*